US005803842A

United States Patent [19]

Ross

[11] Patent Number: 5,803,842

[45] Date of Patent: Sep. 8, 1998

[54] COLLAPSIBLE PITCHER'S PRACTICE CAGE

[76] Inventor: Charles E. Ross, 2414 Lakeside Dr., Centralia, Ill. 63801

[21] Appl. No.: 798,658

[22] Filed: Feb. 11, 1997

[51] Int. Cl.[6] ..... A63B 69/00

[52] U.S. Cl. ..... 473/456

[58] Field of Search ..... 473/451, 432, 473/454, 455, 456, 194, 197; 297/16.1, 16.2

[56] References Cited

U.S. PATENT DOCUMENTS

| | | | |
|---|---|---|---|
| 4,889,383 | 12/1989 | Jones | 297/16.1 |
| 5,054,848 | 10/1991 | Liu | 297/16.1 X |
| 5,193,802 | 3/1993 | Saltus | 473/432 |
| 5,588,645 | 12/1996 | Schwan et al. | 473/456 |

*Primary Examiner*—William H. Grieb

*Attorney, Agent, or Firm*—Armstrong, Teasdale, Schlafly & Davis

[57] ABSTRACT

The present invention, in one form, is a collapsible pitcher's practice cage including a frame and a fabric enclosure. The frame includes a first portion and a second portion. The frame second portion is pivotally coupled to the frame first portion so that the frame second portion is movable between a first position, where frame second portion is substantially perpendicular to frame first portion, and a second position, where frame second portion is substantially parallel to frame first portion. The fabric enclosure includes a rear wall and a bottom wall and is foldably coupled to the frame. Particularly, the rear wall is coupled to the frame first portion and the bottom wall is coupled to the frame second portion so that when the frame second portion is in the first position, the rear wall is substantially perpendicular to the bottom wall, and so that when the frame second portion is in the second position, the rear wall is substantially parallel to the bottom wall.

18 Claims, 2 Drawing Sheets

COLLAPSIBLE PITCHER'S PRACTICE CAGE

FIELD OF THE INVENTION

This invention relates generally to sports training apparatus and, more particularly, to portable practice apparatus for developing abilities for accurately throwing, for example, baseballs or softballs.

BACKGROUND OF THE INVENTION

To succeed in sports such as baseball and softball, a person typically must possess the ability to accurately throw a ball. Such ability is particularly necessary for a pitcher in either such sport. Practice often is necessary both to develop and to maintain accurate throwing abilities.

One known practice technique requires at least two persons to play catch. Particularly, a thrower throws a ball to a catcher, who then returns the ball to the thrower. While this practice technique is well known and generally successful, such technique requires the participation of at least two people. Often, however, the person desiring to throw the ball is unable to locate a second person. Accordingly, it is desirable to provide an apparatus facilitating the development of ball throwing skills without requiring two persons.

One known apparatus substitutes for a catcher and includes a frame and a tiltable target slab. The slab is configured to be tilted at a desired angle, and the slab is sufficiently hard to permit a thrown ball to be returned to the thrower. Particularly, when a thrown ball hits the slab, the ball rebounds off of the slab and returns to the thrower. Accordingly, the apparatus requires the thrower to hit the target and to field the ball after it rebounds off of the target. However, if the thrower misses the target, or is unable to field the ball, the thrower must find and retrieve the ball, which may be located a considerable distance away from the thrower and the target.

Another known apparatus includes a target positioned within an enclosure. The enclosure is typically sized to receive a thrown ball even if the thrown ball misses the target. Accordingly, if the thrower misses the target, then the ball is retained within the enclosure. Retrieving an errantly thrown ball, therefore, is simplified. However, the known apparatus typically are not simple to construct, simple to store, and simple to transport.

It would be desirable to provide an apparatus to facilitate developing throwing capabilities which is simple to construct. It also would be desirable to provide such an apparatus which is portable and simple to store.

SUMMARY OF THE INVENTION

These and other objects may be attained with a collapsible pitcher's practice cage which, in one embodiment, includes a frame and a foldable fabric enclosure. The frame includes a first portion and a second portion, and the frame second portion is pivotally coupled to the frame first portion. The frame second portion is movable to a first, or open, position in which the frame second portion is substantially perpendicular to the frame first portion. The frame second portion also is movable to a second, or closed, position in which the frame second portion is substantially parallel to the frame first portion. In the closed position, the frame is substantially flat, i.e., the frame second portion is substantially adjacent to the frame first portion, to facilitate moving and storing the closed practice cage.

The fabric enclosure includes a rear wall and a bottom wall and is foldably coupled to the frame. Particularly, the rear wall is coupled to the frame first portion and the bottom wall is coupled to the frame second portion. When the frame second portion is in the first position, the enclosure rear wall is substantially perpendicular to the bottom wall and when the frame second portion is in the second position, the enclosure rear wall is substantially adjacent and parallel to the bottom wall.

The collapsible pitcher's practice cage described above is substantially simple to construct. In addition, such practice cage is portable and substantially simple to store.

DETAILED DESCRIPTION OF THE DRAWINGS

Figure 1:
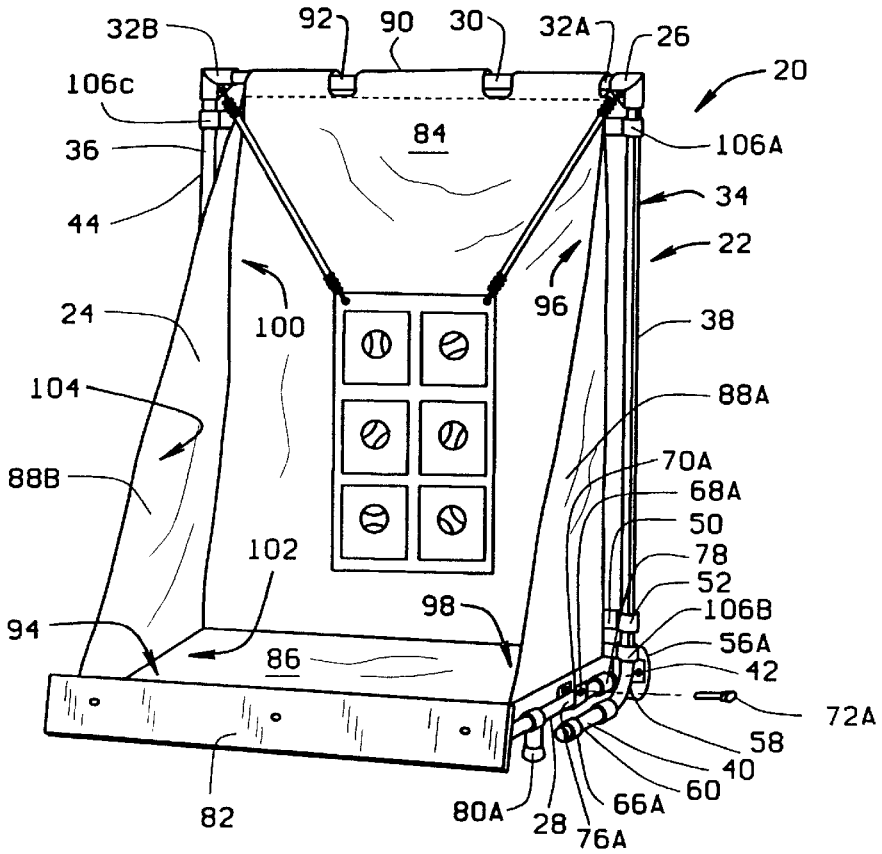
FIG. 1 is a front perspective view of a pitcher's practice cage in accordance with one embodiment of the present invention in an open position.

FIG. 1 illustrates a front perspective view of a pitcher's practice cage 20 in accordance with one embodiment of the present invention in a first, or open, position. Pitcher's practice cage 20 includes a frame 22 and a fabric enclosure 24. Frame 22 includes a first portion 26 and a second portion 28. First portion 26 of frame 22 is substantially "U"-shaped and includes a top member 30 having first and second ends 32A and 32B. A first side leg 34 is coupled to first end 32A and a second side leg 36 is coupled to second end 32B so that first and second side legs 34 and 36 are substantially parallel. First side leg 34 is substantially "L"-shaped, and a first portion 38 of first side leg 34 extends substantially perpendicular to a second portion 40 of first side leg 34 at a bend portion 42. Similarly, second side leg 36 is substantially "L"-shaped, and a first portion 44 of second side leg 36 extends substantially perpendicular to a second portion 46 of second side leg 36 at a bend portion 48 (only first portion 44 of second side leg 36 is shown in FIG. 1).

A lower cross-member 50 extends between first side leg 34 and second side leg 36 and is spaced from top member 30. A first end 52 of lower cross-member 50 is coupled to first side leg 34 adjacent bend portion 42, and a second end 54 (not shown in FIG. 1) of lower cross-member 50 is coupled to second side leg 36 adjacent bend portion 48. Particularly, first end 52 of lower cross-member 50 is coupled to first portion 38 of first side leg 34 and second end 54 of lower cross-member 50 is coupled to first portion 44 of second side leg 36.

Frame first portion 26 further includes first and second wheels 56A and 56B (only first wheel 56A is shown in FIG. 1) for facilitating transporting of pitcher's practice cage 20 between different locations, e.g., between a garage and a yard. First wheel 56A is coupled to first side leg 34 and second wheel 56B is coupled to second side leg 36. First wheel 56A is positioned adjacent first side leg bend portion 42 so that when second portion 40 of first side leg 34 is substantially horizontal, a lower surface 58 of first wheel 56A is vertically spaced from a lower surface 60 of first side leg second portion 40. Similarly, second wheel 56B is positioned adjacent bend second side leg portion 48 so that when second portion 46 of second side leg 36 is substantially horizontal, a lower surface 62 of second wheel 56B is vertically spaced from a lower surface 64 of second side leg second portion 46.

Frame first portion 26 further includes latches 66A and 66B (only latch 66A is shown in FIG. 1). Latch 66A is coupled to second portion 40 of first side leg 34 and latch 66B is coupled to second portion 46 of second side leg 36. Latches 66A and 66B may, for example, be devises 68A and 68B, respectively (only clevis 68A is shown in FIG. 1) sized to receive at least a portion of frame second portion 28. Clevis 68A includes openings 70A in each leg 70A, and openings 70A are substantially aligned so that a pin 72A may be extended through openings 70A and secure at least a portion of frame second portion 28 within clevis 68A. Similarly, clevis 68B includes openings 70B (not shown) in each leg, and openings 70B are substantially aligned so that a pin 72B (not shown) may be extended through openings 70B and secure at least a portion of frame second portion 28 within clevis 68B.

Frame second portion 28 is pivotally coupled to frame first portion 26 and also is substantially "U"-shaped. Frame second portion 28 includes a front member 74 having two first and second side legs 76A and 76B, respectively, extending therefrom (only side leg 76A is shown in FIG. 1). First side leg 76A of frame second portion 28 is pivotally coupled to second portion 40 of first side leg 34 of frame first portion 26 with, for example, a hinge 78A. Similarly, second side leg 76B of frame second portion 28 is pivotally coupled to second portion 46 of second side leg 36 of frame first portion 26 with, for example, a hinge 78B (not shown in FIG. 1). Accordingly, frame second portion 28 may pivot between the open position, where first and second side legs 76A and 76B of frame second portion 28 are substantially parallel to second portions 40 and 46, respectively, of first and second legs 34 and 36 of frame first portion 26, and a second, or closed, position (not shown in FIG. 1), where first and second side legs 76A and 76B of frame second portion 28 are substantially parallel to first portions 38 and 44, respectively, of first and second legs 34 and 36 of frame first portion 26.

Frame second portion 28 further includes stabilizing legs 80A and 80B (only stabilizing leg 80A is shown in FIG. 1) and a ground shield 82. Ground shield 82 is coupled to front member 74 and stabilizing legs 80A and 80B are coupled to first and second side legs 76A and 76B, respectively, of frame second portion 28.

Fabric enclosure 24 is coupled to both frame first portion 26 and frame second portion 28 and is configured to fold between the closed, e.g., storage position and the open position when frame second portion is pivoted between the closed position and the open position, respectively. Fabric enclosure 24 includes a rear wall 84, a bottom wall 86 and two side walls 88A and 88B. A first end 90 of rear wall 84 includes a bore 92 and is coupled to frame first portion 26 by extending top member 30 of frame first portion 26 through bore 92. Accordingly, rear wall 84 extends between and substantially parallel to first and second side legs 34 and 36, respectively, of frame first portion 26.

A first end 94 of bottom wall 86 is coupled to frame second portion 28 so that bottom wall 86 extends between and substantially parallel to first and second side legs 76A and 76B, respectively, of frame second portion 28 Bottom wall first end 94 may, for example, include a bore (not shown) and may be coupled to front member 74 of frame second portion 28 by extending front member 74 through the bore. Alternatively, bottom wall first end 94 may be coupled to ground shield 82.

Fabric enclosure side walls 88A and 88B are substantially parallel and extend between rear wall 84 to bottom wall 86. Particularly, side wall 88A extends between a first side 96 of rear wall 84 and a first side 98 of bottom wall 86 and projects substantially perpendicularly from both rear wall 84 and bottom wall 86. Similarly, side wall 88B extends between a second side 100 of rear wall 84 to a second side 102 of bottom wall 86 and projects substantially perpendicularly from both rear wall 84 and bottom wall 86. Substantially parallel side walls 88A and 88B and bottom wall 86 define a ball receiving cavity 104.

Fabric enclosure 24 further includes four straps 106A, 106B, 106C and 106D (only three straps 106A, 106B and 106C are shown in FIG. 1) to facilitate securing fabric enclosure 24 to frame 22. Alternatively, either more than four or fewer than four straps may be used. Two straps 106A and 106B are coupled to first leg portion 38 of first side leg 34 and two straps 106C and 106D are coupled to first leg portion 44 of second side leg 36.

Pitcher's practice cage 20 also includes a pitching target 108 coupled to frame 22. Pitching target 108 is substantially rectangular and is coupled to frame first portion 26 so that pitching target 108 is adjacent rear wall 84 of fabric enclosure 24. Particularly, pitching target 108 is coupled to frame first portion 26 so that when pitcher's practice cage 20 is in the open position, pitching target 108 is spaced above bottom wall 86 and between first and second sidewalls 88A and 88B, respectively, of fabric enclosure 24. Pitching target 108 may be coupled to top member 30 of frame first portion 26 with connecting rods 110. Alternatively, pitching target 108 may be coupled to frame first portion 26 with cords or springs, or may even, for example, be drawn or painted on rear wall 84 of fabric enclosure 24.

Figure 2:
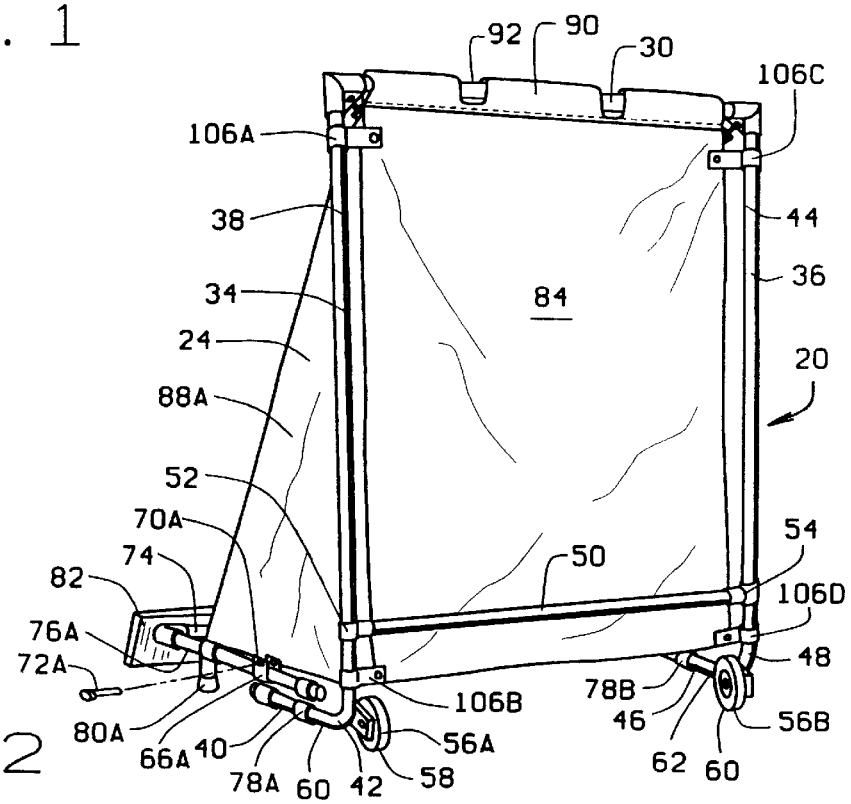
FIG. 2 is a rear perspective view of the pitcher's practice cage of FIG. 1.

FIG. 2 is a rear perspective view of pitcher's practice cage 20. As shown more clearly in FIG. 2, frame first portion second side leg 36 is substantially "L"-shaped and second wheel 56B is coupled to second side leg 36 adjacent bend portion 48. Straps 106A and 106C are coupled to frame 22 adjacent top member 30 of frame first portion 26. Straps 106B and 106D are coupled to frame first portion 106 adjacent bend portions 42 and 48 of first side leg 34 and second side leg 36, respectively. As shown in FIG. 2, straps 106A, 106B, 106C and 106D facilitate securing fabric enclosure 24 to frame 22 and particularly, securing rear wall 84 of fabric enclosure 24 to frame first portion 26.

Figure 3:
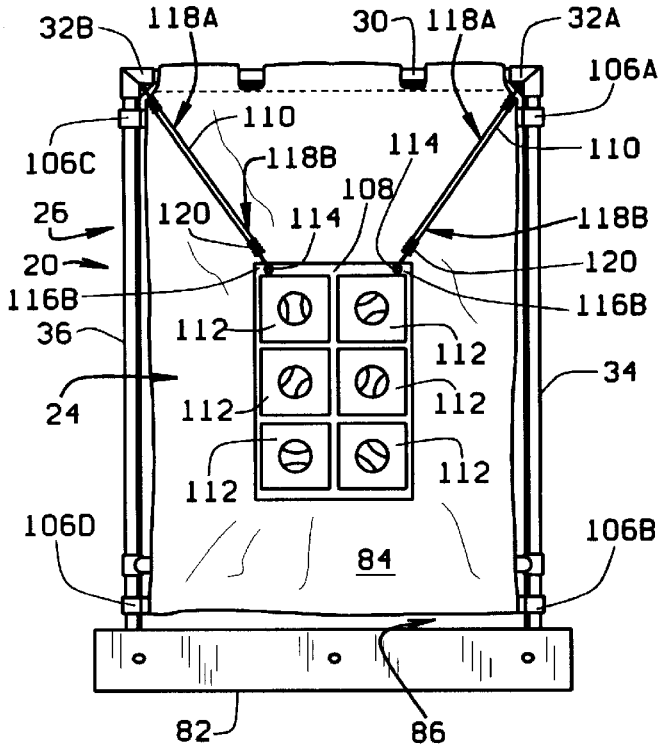
FIG. 3 is a front view of the pitcher's practice cage of FIG. 1.

FIG. 3 is a front view of pitcher's practice cage 20 having pitching target 108 spaced from rear wall 84 of fabric enclosure 24. Pitching target 108 includes a plurality of aiming regions 112 and includes coupling openings 14 adjacent target corners 116A and 116B. Connecting rods 110 each include a first end 118A and a second end 118B. Connecting rod first ends 118A are coupled to frame first portion 26 adjacent top member first end 32A and top member second end 32B, respectively. Connecting rod second ends 118B each include a hook 120 which extends through a respective pitching target coupling opening 114 to suspend pitching target 108 above bottom floor 86 of fabric enclosure 24 so that pitching target 108 is substantially centered in front of fabric enclosure rear wall 84.

Figure 4:
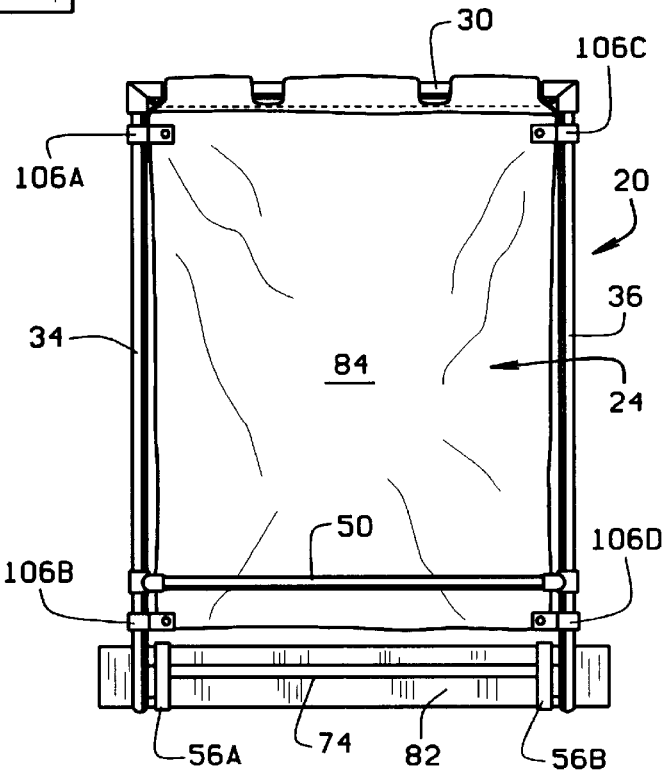
FIG. 4 is a rear view of the pitcher's practice cage of FIG. 1.

FIG. 4 is a rear view of pitcher's practice cage 20. First and second wheels 56A and 56B are positioned between first and second side legs 34 and 36 of frame first portion 26.

Ground shield 82 is coupled to front member 74 of frame second portion 28 and extends beyond both side legs 34 and 36 of frame first portion 26.

Figure 5:
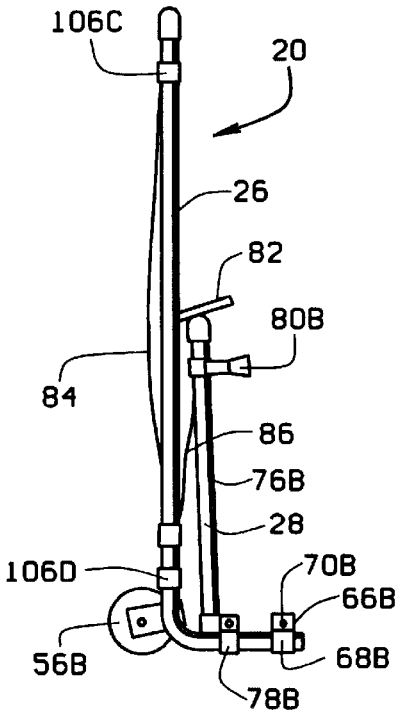
FIG. 5 is a side view of the pitcher's practice cage of FIG. 1 in a closed position.

FIG. 5 is a side view of pitcher's practice cage 20 in the closed position. Hinge 78B is configured to pivot frame second portion 28 so that frame second portion 28 is substantially parallel to frame first portion 26. In the closed position, pitcher's practice cage 20 is substantially flat. Particularly, frame first portion 26 is substantially adjacent frame second portion 28 and enclosure rear wall 84 is substantially adjacent enclosure bottom wall 86. In the closed position, frame 22 may be tilted so that only wheels 56A and 56B contact the ground, and pitcher's practice cage 20 may be transported, e.g., rolled, and may be stored, for example, in a narrow space such as a closet. Pitching target 108 (not shown in FIG. 5) is configured to be coupled to frame first portion 26 when practice cage 20 is in the closed position.

Fabric enclosure 24 is formed of an impact-absorbent material which substantially absorbs impact when struck by a thrown ball so that the thrown ball will not rebound and return to the person who threw the ball. In addition, fabric enclosure 24 is formed of a fabric which substantially resists breaking or tearing when struck by a thrown ball. For example, fabric enclosure 24 may be formed from canvas or nylon or a combination thereof.

In operation, closed pitcher's practice cage 20 is rolled on wheels 56A and 56B to a desired location. Particularly, closed pitcher's practice cage 20 is tilted so that only wheels 56A and 56B contact the ground, and is then rolled. At the desired location, practice cage 20 is tilted so that second portions 40 and 46 of frame first member side legs 34 and 36, respectively, abut the ground. Pitcher's practice cage is then opened, i.e., frame second portion 28 is pivoted, via hinges 78A and 78B, with respect to frame first portion 26 so that frame second portion 28 is substantially perpendicular to frame first portion 26 and so that fabric enclosure rear wall 84 is substantially perpendicular to fabric enclosure bottom wall 86. Pins 72A and 72B are removed from devises 68A and 68B, respectively, so that side legs 76A and 76B of frame second portion 28 are positioned in and extend through devises 68A and 68B, respectively. Pins 72A and 72B are then inserted through pin openings 70A and 70B, respectively, i.e., latches 66A and 66B are engaged, to secure frame second portion 28 substantially perpendicular to frame first portion 26.

In the open position, frame second portion stabilizing legs 80A and 80B abut the ground so that frame second portion 28 is substantially parallel to the ground and so that ground shield 82 is adjacent the ground to substantially prevent a thrown ball from entering an area between frame second portion 28 and the ground. For example, ground shield 82 may abut the ground.

Pitching target 108 is coupled to frame 22 so that pitching target 108 is adjacent fabric enclosure rear wall 84 and spaced from fabric enclosure bottom wall 86. A ball, such as a baseball or a softball, is then thrown at pitching target 108. If the thrown ball strikes either pitching target 108 or fabric enclosure rear wall 84, then the thrown ball drops to fabric enclosure bottom wall 82. Fabric enclosure 24, and particularly bottom wall 82 is sized to retain a plurality of thrown balls. After throwing one or more balls, the thrower then retrieves the thrown balls from fabric enclosure 24.

After using practice cage 20, practice cage 20 is closed so that it is readily-storable. Particularly, latches 78A and 78B are disengaged, i.e., pins 72A and 72B are removed from devises 68A and 68B, respectively, so that frame second portion 28 may move relative to frame first portion 26, and frame second portion 28 is pivoted via hinges 78A and 78B to the closed position. Accordingly, frame first portion 26 is substantially parallel to frame second portion 28 and fabric enclosure rear wall 84 is substantially parallel to fabric enclosure bottom wall 86. Pitching target 108 may, if desired, be removed before closing pitcher's practice cage 20. However, pitching target 108 may also remain coupled to frame 22 when closing pitcher's practice cage 20. Pitcher's practice cage 20 may then be moved via wheels 56A and 56B and stored, for example, in a garage or closet.

The above-described pitcher's practice cage is readily-storable and substantially simple to transport. In addition, such practice cage is substantially simple to construct and use.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. An apparatus comprising:

a frame comprising a first portion and a second portion, said frame second portion pivotally coupled to said frame first portion and movable to a first position in which said frame second portion is substantially perpendicular to said frame first portion, and a second position in which said frame second portion is substantially parallel to said frame first portion; and a fabric enclosure comprising a rear wall and a bottom wall, said rear wall coupled to said frame first portion and said bottom wall coupled to said frame second portion; and a pitching target coupled to said frame first member.

2. An apparatus in accordance with claim 1 wherein said frame first portion comprises a substantially "U"-shaped member comprising a top member having two side legs extending therefrom, and wherein said rear wall of said fabric enclosure is coupled to said top member.

3. An apparatus in accordance with claim 2 wherein said fabric enclosure rear wall includes a first end having a bore, and wherein said top member of said frame first portion extends through said first end bore of said rear wall.

4. An apparatus in accordance with claim 1 wherein said frame second portion comprises a substantially "U"-shaped member comprising a front member having two side legs extending therefrom, and wherein said bottom wall of said fabric enclosure is coupled to said front member.

5. An apparatus in accordance with claim 4 wherein said bottom wall includes a first end having a bore, and wherein said front member of said frame second portion extends through said first end bore of said bottom wall.

6. An apparatus in accordance with claim 1 further comprising a ground shield coupled to said frame second portion.

7. An apparatus in accordance with claim 1 wherein said fabric enclosure comprises impact-absorbent material.

8. An apparatus in accordance with claim 1 wherein said pitching target is coupled to said frame first portion so that when said frame is positioned in said first position, said pitching target is spaced from said bottom wall of said fabric enclosure.

9. An apparatus in accordance with claim 1 further comprising at least one wheel coupled to said frame.

10. An apparatus comprising:

a frame comprising a substantially "U"-shaped first portion and a substantially "U"-shaped second portion, said frame first portion comprising a top member and two side legs, said frame second portion comprising a front member and two side legs, said side legs of said frame second portion pivotally coupled to said side legs of said frame first portion, said frame second portion movable to a first position in which said frame second portion is substantially perpendicular to said frame first portion, and a second position in which said frame second portion is substantially parallel and adjacent to said frame first portion; and a fabric enclosure comprising a rear wall and a bottom wall, said rear wall coupled to said top member of said frame first portion and said bottom wall coupled to said front member of said frame second portion; and a pitching target coupled to said frame first portion.

11. An apparatus in accordance with claim 10 wherein each of said side legs of said frame first portion is substantially "L"-shaped.

12. An apparatus in accordance with claim 10 further comprising a ground shield coupled to said front member of said frame second portion.

13. An apparatus in accordance with claim 10 further comprising two wheels, one of said wheels attached to one of said side legs of said first frame portion, the other of said wheels attached to the other of said side legs of said first frame portion.

14. An apparatus comprising:

a frame comprising a substantially "U"-shaped first portion and a substantially "U"-shaped second portion, said frame first portion comprising a top member and first and second side legs extending therefrom, said frame second portion comprising a front member and first and second side legs extending therefrom, said first side leg of said frame second portion pivotally coupled to said first side leg of said frame first portion, said second side leg of said frame second portion pivotally coupled to said second side leg of said frame first portion, said frame second portion movable to a first position in which said frame second portion is substantially perpendicular to said frame first portion, and a second position in which said frame second portion is substantially parallel and adjacent to said frame first portion;

a fabric enclosure comprising a rear wall and a bottom wall, said fabric enclosure foldable between an open position in which said rear wall is substantially perpendicular to said bottom wall, and a closed position in which said rear wall is substantially parallel to said bottom wall, said rear wall coupled to said top member of said frame first portion and said bottom wall coupled to said front member of said frame second portion so that when said frame is in said first position, said fabric enclosure is in said open position, and so that when said frame is in said second position, said fabric enclosure is in said closed position; and first and second wheels, said first wheel coupled to said first side leg of said frame first portion and said second wheel coupled to said second side leg of said frame second portion.

15. An apparatus in accordance with claim 14 wherein said first and second side legs of said frame first portion are substantially "L"-shaped having a first portion extending substantially perpendicular to a second portion at a bend portion, said first portion of each first and second side leg of said frame first portion coupled to said top member, said second portion of each first and second side leg of said frame first portion coupled to said frame second portion.

16. An apparatus in accordance with claim 14 wherein said fabric enclosure further comprises a first side wall and a second side wall.

17. An apparatus in accordance with claim 14 further comprising a support member coupled to and extending between said first and second side legs of said frame first portion.

18. An apparatus in accordance with claim 14 further comprising a pitching target coupled to said top member.

* * * * *